US006851600B1

(12) United States Patent
Fus, Sr.

(10) Patent No.: US 6,851,600 B1
(45) Date of Patent: Feb. 8, 2005

(54) PHOTO FINISHING ENVELOPE

(75) Inventor: James Francis Fus, Sr., Mount Pleasant, IA (US)

(73) Assignee: Mackay Envelope Company, LLC, Minneapolis, MN (US)

( * ) Notice: Subject to any disclaimer, the term of this patent is extended or adjusted under 35 U.S.C. 154(b) by 0 days.

(21) Appl. No.: 10/118,149

(22) Filed: Apr. 8, 2002

(51) Int. Cl.[7] ..... B65D 27/08
(52) U.S. Cl. ..... 229/72; 229/80
(58) Field of Search ..... 229/80, 80.5, 72; 383/84, 86, 86.1; 206/455, 232

(56) References Cited

U.S. PATENT DOCUMENTS

| | | | | | |
|---|---|---|---|---|---|
| 1,974,339 | A | * | 9/1934 | McDonald | 229/80 |
| 2,066,495 | A | * | 1/1937 | Swift | 229/80 |
| 3,079,066 | A | * | 2/1963 | Roop | 383/86 |
| 3,256,941 | A | * | 6/1966 | Rivman | 383/86 |
| 3,967,776 | A | | 7/1976 | Getsch et al. | |
| 4,047,661 | A | | 9/1977 | Klein | |
| 4,508,224 | A | | 4/1985 | Weber et al. | |
| 4,966,285 | A | | 10/1990 | Otake et al. | |
| 5,060,847 | A | | 10/1991 | Angus et al. | |
| 5,102,035 | A | | 4/1992 | Cecchi | |
| 5,123,589 | A | | 6/1992 | Cote | |
| 5,195,683 | A | | 3/1993 | Gaetano | |
| 5,251,745 | A | | 10/1993 | Repp et al. | |
| 5,251,746 | A | | 10/1993 | Gresh et al. | |
| 5,263,579 | A | | 11/1993 | Blackman | |
| 5,337,942 | A | | 8/1994 | McClelland | |
| 5,398,866 | A | | 3/1995 | Bluemle | |
| 5,400,957 | A | | 3/1995 | Stude | |
| 5,678,754 | A | | 10/1997 | Kranz | |
| 5,704,472 | A | | 1/1998 | Werner et al. | |
| 5,709,496 | A | | 1/1998 | Werner et al. | |
| 5,788,074 | A | | 8/1998 | Tanabe et al. | |
| 5,806,754 | A | | 9/1998 | Boyle | |
| 5,816,392 | A | | 10/1998 | Kawagoe et al. | |
| 5,823,330 | A | | 10/1998 | Werner et al. | |
| 5,833,059 | A | | 11/1998 | Werner et al. | |
| 5,921,463 | A | | 7/1999 | Boyle et al. | |
| 5,984,167 | A | | 11/1999 | Roccaforte | |
| 6,045,034 | A | | 4/2000 | Roccaforte et al. | |
| 6,129,264 | A | | 10/2000 | Travers et al. | |

FOREIGN PATENT DOCUMENTS

| | | | | |
|---|---|---|---|---|
| CA | 0745888 | * | 11/1966 | 229/81 |
| GB | 0494159 | * | 10/1938 | 229/80 |
| GB | 2036692 | * | 7/1980 | 383/84 |

OTHER PUBLICATIONS

Envelope Bearing the Text "Kruidvat Fotoservice," Date Unknown.
Envelope Bearing the Text "Photo Prien Die Profis Fur Film & Bild," Date Unknown.
Envelope Bearing the Text "Quality Photofinishing," Dated 1999.

* cited by examiner

*Primary Examiner*—Jes F. Pascua
(74) *Attorney, Agent, or Firm*—Allen W. Groenke; Fredrikson & Byron, P.A.

(57) ABSTRACT

Methods and apparatus for enclosing items in a package are disclosed. A package in accordance with an exemplary embodiment of the present invention includes a first pocket having gusseted sides sized receive at least a double set of prints and a cover having a proximal portion coupled to the first pocket at a fold line. A landing strip is advantageously fixed to the cover. An adhesive layer is disposed within a chamber defined by a wall of the first pocket. The adhesive layer overlays an aperture defined by the wall of the first pocket so that the adhesive layer comprises a covered portion and an exposed portion. The aperture and the landing strip are preferably positioned so that the landing strip overlays the aperture when the cover is in a closed position.

11 Claims, 17 Drawing Sheets

PHOTO FINISHING ENVELOPE

FIELD OF THE INVENTION

The present invention relates generally to packages for storing and protecting photographic prints, and associated items such as, for example, photographic negatives, index prints, magnetic discs, and compact optical discs.

BACKGROUND OF THE INVENTION

Home photography is very popular at least in part because it provides an inexpensive way to make a record of special occasions. Photographs are frequently used to make a record of adult family members and children as they grow. Photographs also proved an easy way to share images of special events and portraits of children with family members who are living far away.

Many department stores such as Costco and Walmart offer a wide variety of photo processing services. It is convenient for a consumer to drop off a print order during a shopping trip to one of these stores. Typically these stores provide an order counter with a number of counter envelopes. The consumer can write their name and address on the envelope and check boxes corresponding to the desired photo processing services. A variety of services are available, including single prints, double prints, images on a disc, images on a CD, images delivered via e-mail and images posted on a website.

When placing an order, the consumer can place an item (e.g. a roll of film, a magnetic floppy disk, a compact optical disk, and the like) in the envelope, tear off a receipt and drop the envelope in a slot located on the order counter. A short time later, the consumer can pick up the prints during another visit to the store. The prints may be provided to the customer in a variety of ways. For example, the prints may be provided as images on photographic paper. By way of a second example, the prints may be provided as digital images saved on a storage media such as a compact optical disk or a magnetic floppy disk.

The printing process typically includes the step of placing the customers images onto photographic paper and/or converting images to digital files. When the images are delivered electronically, they can be posted on a web page or delivered to an e-mail address. The digital files can also be saved on a storage media such as a compact optical disk or a magnetic floppy disk.

SUMMARY OF THE INVENTION

A package in accordance with an exemplary embodiment of the present invention includes a first pocket having gusseted sides sized receive at least a double set of prints and a cover having a proximal portion coupled to the first pocket at a fold line. A landing strip is advantageously fixed to the cover. An adhesive layer is disposed within a chamber defined by a wall of the first pocket. The adhesive layer overlays an aperture defined by the wall of the first pocket so that the adhesive layer comprises a covered portion and an exposed portion. The aperture and the landing strip are preferably positioned so that the landing strip overlays the aperture when the cover is in a closed position.

In one aspect of this exemplary implementation, the landing strip includes an upper portion and a lower portion. The upper portion of the landing strip is advantageously dimensioned to overlay the exposed portion of the adhesive layer when the gusseted sides of the first pocket are in a collapsed position. Additionally, the lower portion of the landing strip is advantageously dimensioned to overlay the exposed portion of the adhesive layer when the gusseted sides of the first pocket are in an expanded position.

In certain implementations, a package in accordance with the present invention further includes a second pocket having gusseted sides sized to receive at least a set of negatives. In some cases, the second pocket is coupled to the first pocket by a plurality of frangible links so that the second pocket can be selectively separated from the first pocket.

In one aspect of the exemplary implementation, an outer surface of the adhesive layer is disposed below an outer surface of the wall of the first pocket. In another aspect of the exemplary implementation, the landing strip and the outer surface of the adhesive layer define an angle when a portion of the landing strip is adhered to the exposed portion of the adhesive layer. In some embodiments, the angle is greater than about 30 minutes. In certain advantageous embodiments, the angle is greater than about 1 degree. In some cases, the aperture has a dimension similar to a dimension of a human finger tip.

In one aspect of the exemplary implementation, the covered portion of the adhesive layer has a surface area greater than a surface area of the exposed portion of the adhesive layer. In another aspect of the exemplary implementation, a distal end of the landing strip is disposed proximate a distal end of the cover.

In certain implementations, the package includes a substrate overlaying an inner surface of the adhesive layer. When this is the case, the adhesive layer and the substrate may advantageously form a first interface having a first peel strength. Also in this case, the adhesive layer and the landing strip may form a second interface having a second peel strength when a portion of the landing strip is adhered to the exposed portion of the adhesive layer. In an advantageous implementation, the second peel strength is different from the first peel strength. In a particularly advantageous implementation, the first peel strength is greater than the second peel strength.

In an advantageous aspect of the present invention, the landing strip and the adhesive layer may be adhered and separated a plurality of times. In a particularly advantageous implementation, the landing strip and the adhesive layer may be adhered and separated more than five times. A exemplary method in accordance with the present invention may include the steps of providing a package comprising an adhesive layer fixed to a first pocket and a landing strip fixed to a cover and positioning the cover so that the landing strip overlays an exposed portion of the adhesive layer. The landing strip may be deflected so that the landing strip defines a contact angle with the adhesive layer, and the landing strip may be adhered to the exposed portion of the adhesive layer for selectively fixing the cover in a closed position. The landing strip may be selectively separated from the adhesive layer for placing the cover in an open position, and the landing strip may be subsequently adhered to the exposed portion of the adhesive layer for an additional time. Advantageously, the steps of adhering and separating the landing strip and the adhesive layer may be repeated a plurality of times.

DETAILED DESCRIPTION OF THE PREFERRED EMBODIMENT

The following detailed description should be read with reference to the drawings, in which like elements in different drawings are numbered identically. The drawings, which are not necessarily to scale, depict selected embodiments and are not intended to limit the scope of the invention. Examples of constructions, materials, dimensions, and manufacturing processes are provided for selected elements. All other elements employ that which is known to those of skill in the field of the invention. Those skilled in the art will recognize that many of the examples provided have suitable alternatives that can be utilized.

Figure 1:
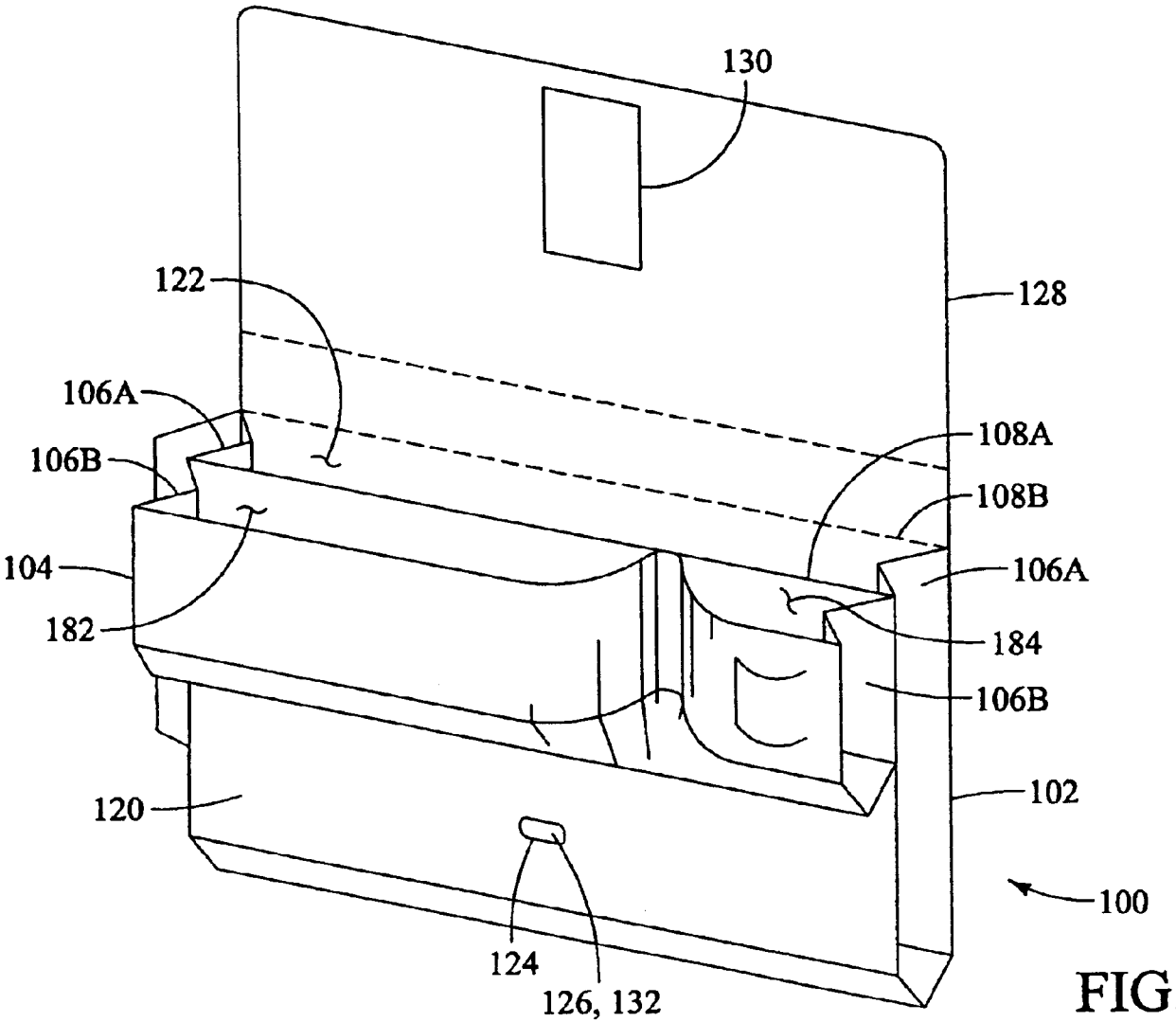
FIG. 1 is a perspective view of a package for holding negatives and prints in accordance with an exemplary embodiment of the present invention.

FIG. 1 is a perspective view of a package 100 for holding negatives and prints in accordance with an exemplary embodiment of the present invention. In the exemplary embodiment of FIG. 1, package 100 includes a first pocket 102 and a second pocket 104. In FIG. 1 it may be appreciated that first pocket 102 has gusseted sides 106A. In a preferred embodiment, gusseted sides 106A are dimensioned so that first pocket 102 will receive at least a double set of prints.

In the embodiment of FIG. 1, second pocket 104 has gusseted sides 106B. In a preferred embodiment, gusseted sides 106B of second pocket 104 are dimensioned so that second pocket 104 will receive at least a set of negatives. Also in the embodiment of FIG. 1, second pocket 104 includes a first cavity 182 and a second cavity 184. In a preferred embodiment, first cavity 182 is dimensioned to receive a plurality of negative strips, and second cavity 184 is dimensioned to receive a cassette. In some embodiments, second cavity 184 is dimensioned to receive a cassette for use with the APS photographic format utilizing drop-in film loading and magnetic capability.

In the embodiment of FIG. 1, second pocket 104 is coupled to first pocket along a fold line 108A. In some embodiments, second pocket 104 may be coupled to first pocket 102 by a plurality of frangible links. In these embodiments, second pocket 104 can be separated from the first pocket 102 by breaking the frangible links.

In the embodiment of FIG. 1, first pocket 102 comprises a wall 120 defining a cavity 122 and an aperture 124. In the embodiment of FIG. 1, an adhesive layer 126 is disposed within cavity 122 of first pocket 102. In FIG. 1, adhesive layer 126 can be seen overlaying aperture 124. Package 100 also includes a cover 128 having a proximal end that is coupled to first pocket 102 at a fold line 108B. In the embodiment of FIG. 1, cover 128 is shown in an open position. Cover 128 preferably also has a closed position in which cover 128 overlays second pocket 104. In FIG. 1, a landing strip 130 is shown affixed to cover 128. Landing strip 130 is preferably positioned such that landing strip 130 will overlay aperture 124 when cover 128 is disposed in the closed position. In a preferred embodiment, a portion of landing strip 130 can be selectively fixed to an exposed portion 132 of adhesive layer 126 for selectively holding cover 128 in the closed position.

Figure 2:
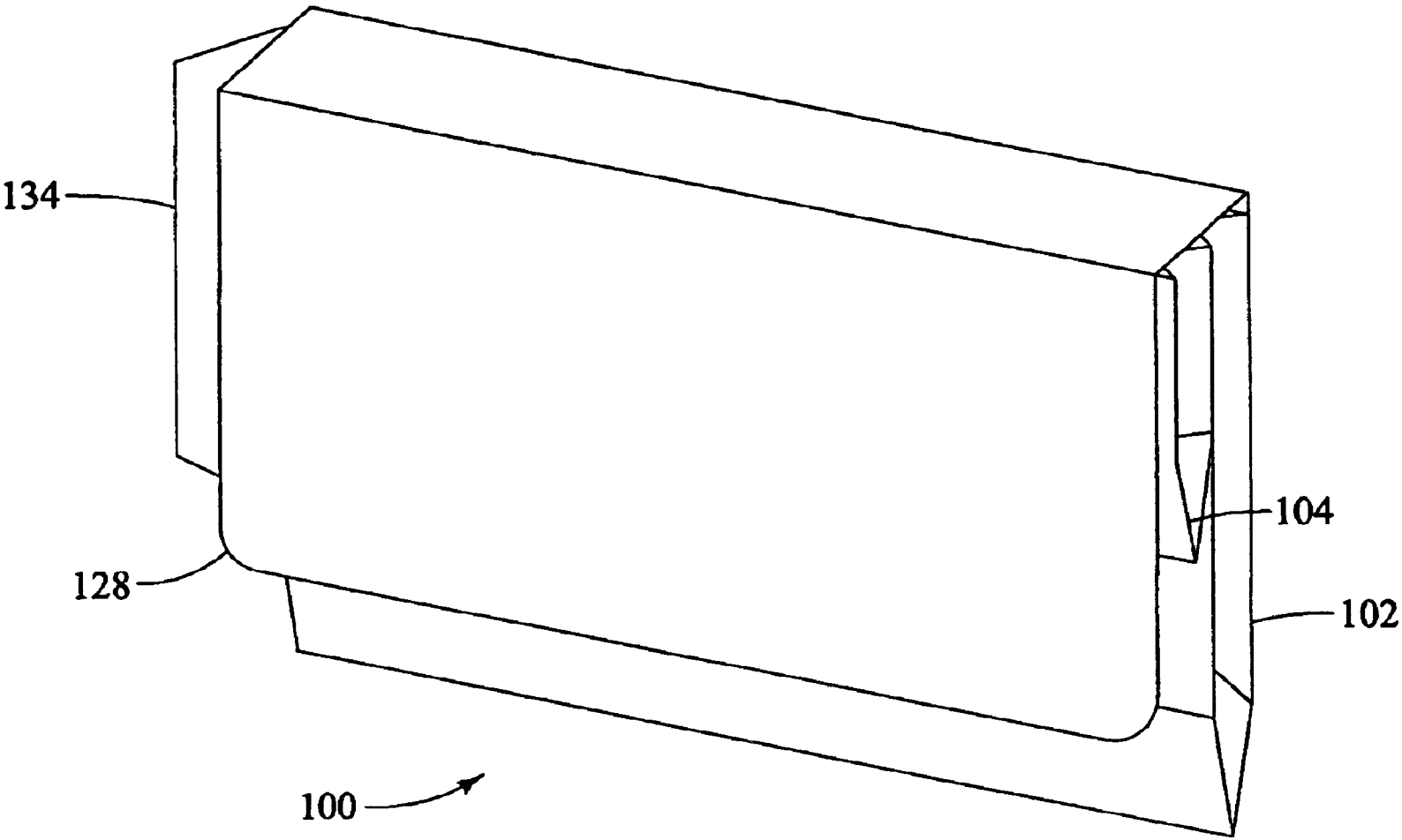
FIG. 2 is an additional perspective view of package of FIG. 1.

FIG. 2 is an additional perspective view of package 100 of FIG. 1. In the embodiment of FIG. 2, cover 128 is disposed in a closed position. In FIG. 2 it may be appreciated that when cover 128 is in a closed position, it overlays second pocket 104. A receipt 134 of package 100 may also be seen in FIG. 2. In some embodiments, receipt 134 may be coupled to first pocket 102 by a plurality of frangible links. In these embodiments, receipt 134 can be separated from the first pocket 102 by breaking the frangible links.

Figure 3:
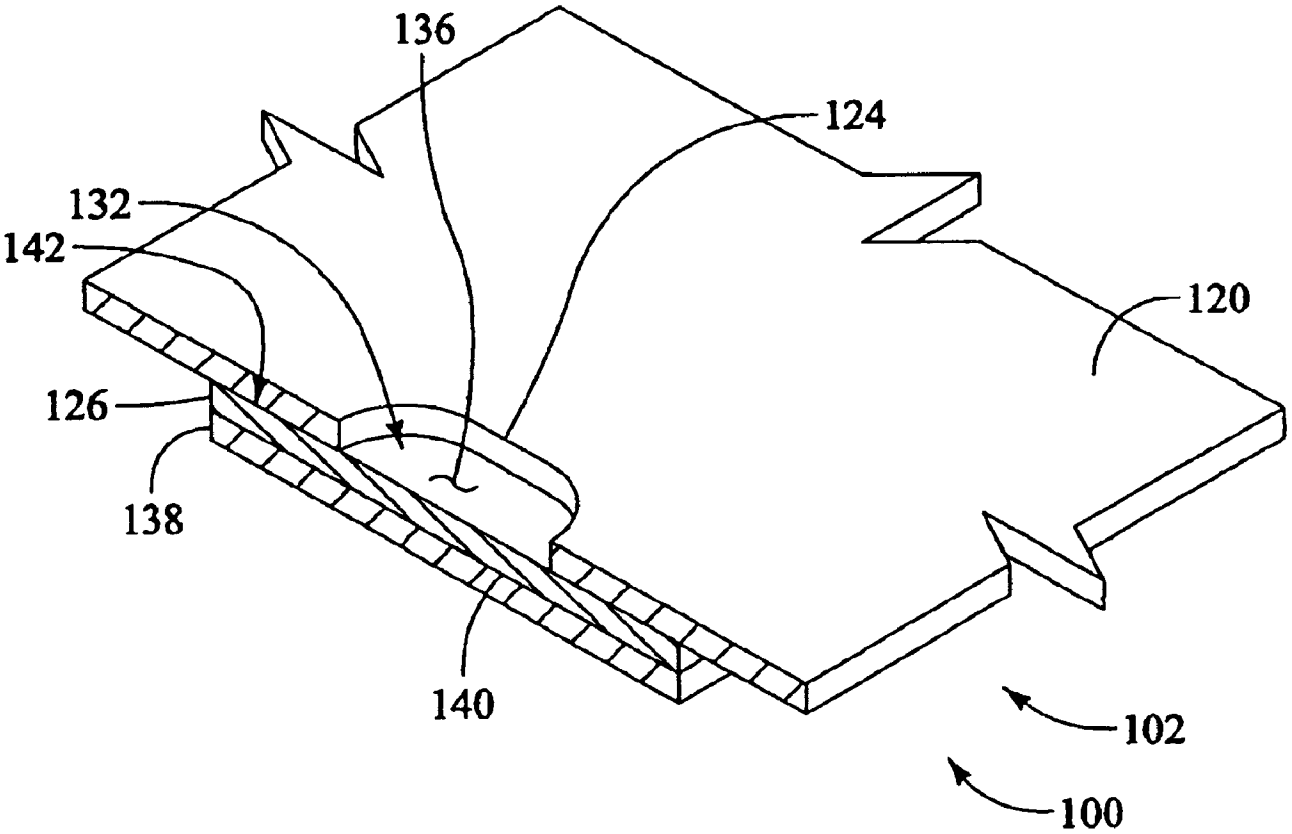
FIG. 3 is a cross sectional perspective view illustrating a portion of package of FIG. 1 and FIG. 2.

FIG. 3 is a cross sectional perspective view illustrating a portion of package 100 of FIG. 1 and FIG. 2. In particular, aperture 124 defined by wall 120 of first pocket 102 is illustrated in FIG. 3. In FIG. 3, an outer surface 136 of adhesive layer 126 can be seen overlaying aperture 124. In FIG. 3 it may be appreciated that a substrate 138 overlays an inner surface 140 of adhesive layer 126.

In FIG. 3, it may be appreciated that adhesive layer 126 comprises a covered portion 142 and an exposed portion 132. In a preferred embodiment, covered portion 142 of adhesive layer 126 has a surface area greater than a surface area of exposed portion 132 of adhesive layer 126. In this preferred embodiment, the relatively large covered portion of adhesive layer 126 securely fixes substrate 138 to wall 120 of first pocket 102. Also in a preferred embodiment, wall 120 of first pocket 102 comprises a porous material, for example, paper. In this preferred embodiment, adhesive layer 126 adheres strongly to wall 120 of first pocket 102. Also in this preferred embodiment, wall 120 may serve to restrain adhesive layer 126 since the porous nature of wall 120 facilitates strong adhesion with adhesive layer 126.

Figure 4:
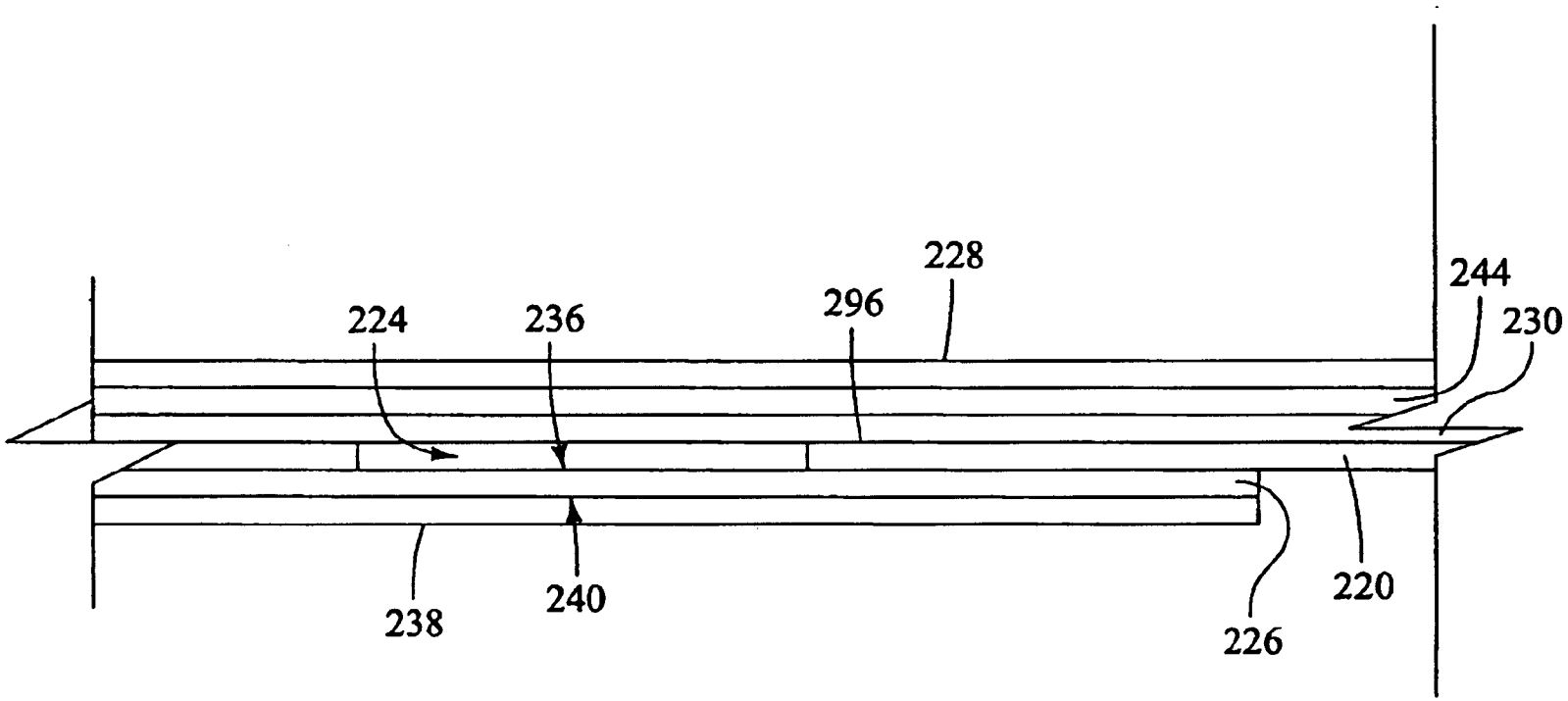
FIG. 4 is a cross sectional view of an assembly in accordance with the present invention.

FIG. 4 is a cross sectional view of an assembly in accordance with the present invention. The assembly of FIG. 4 includes a cover 228 and a wall 220 defining an aperture 224. The assembly of FIG. 4 also includes an adhesive layer 226 having an outer surface 236 and an inner surface 240. In the embodiment of FIG. 4, adhesive layer 226 is disposed so that outer surface 236 overlays aperture 224 of wall 220. A substrate 238 is shown overlaying inner surface 240 of adhesive layer 226 in FIG. 4.

In the embodiment of FIG. 4, a landing strip 230 is fixed to cover 228 by an adhesive 244. In FIG. 4 it may be appreciated that landing strip 230 is shown overlaying an outer surface 296 of wall 220. Also in FIG. 4, landing strip 230 is positioned so as to overlay aperture 224 defined by wall 220. In FIG. 4, it may be appreciated that outer surface 236 of adhesive layer 226 is disposed below outer surface 296 of wall 220, so that outer surface 236 of adhesive layer 226 is not contacting landing strip 230 in the embodiment of FIG. 4.

Figure 5:
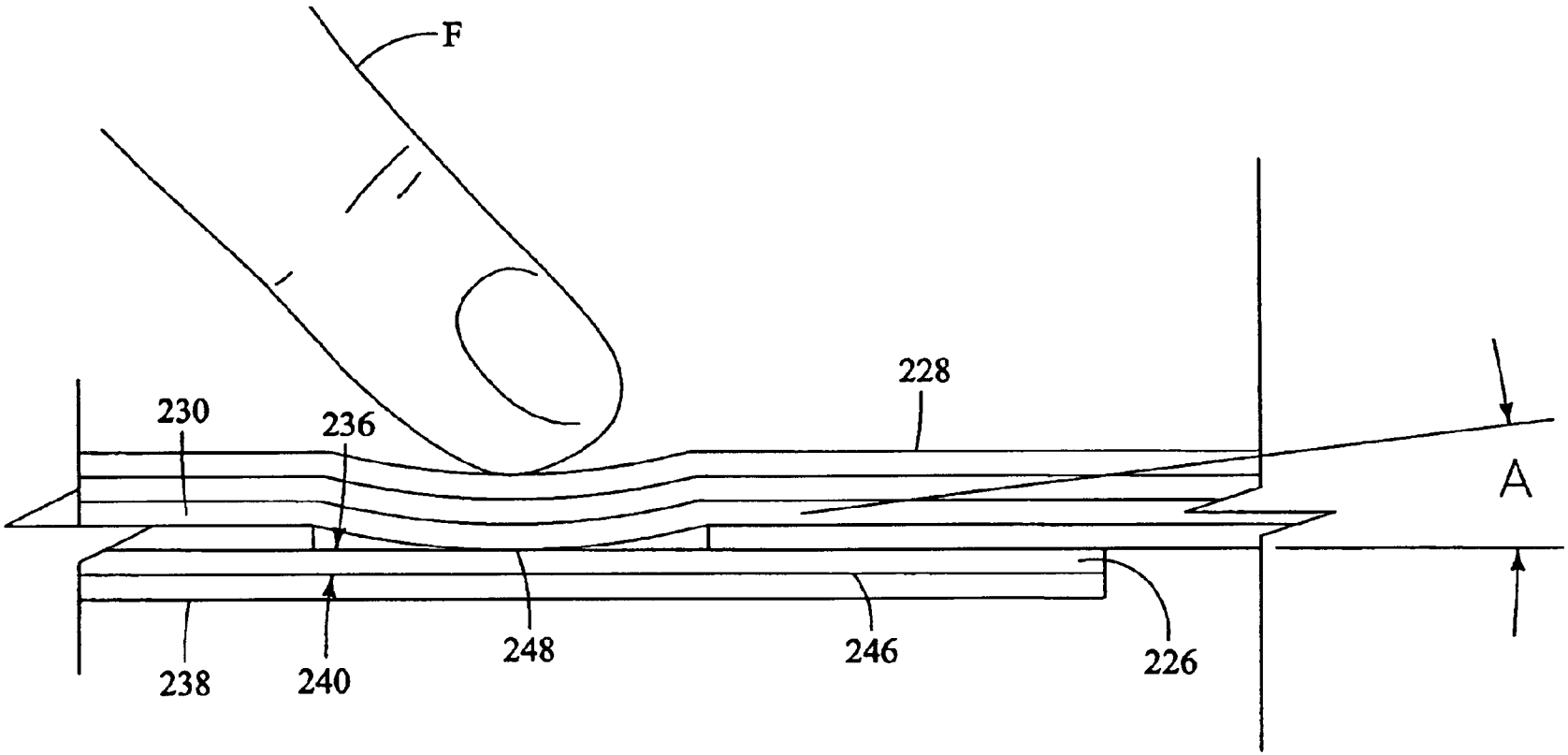
FIG. 5 is an additional cross sectional view of the assembly of FIG. 4.

FIG. 5 is an additional cross sectional view of the assembly of FIG. 4. In the embodiment of FIG. 5, a finger F is shown urging a portion of landing strip 230 downward so that a portion of landing strip 230 is in contact with outer surface 236 of adhesive layer 226. In FIG. 5 it may be appreciated that landing strip 230 and adhesive layer 226 define a contact angle A. In a useful embodiment, contact angle A is greater than about zero. In an advantageous embodiment, contact angle A is greater than about 30 minutes. In a particularly advantageous embodiment, contact angle A is greater than about one degree.

In the embodiment of FIG. 5, inner surface 240 of adhesive layer 226 forms a first interface 246 with substrate 238. Also in the embodiment of FIG. 5, outer surface 236 of adhesive layer 226 forms a second interface 248 with landing strip 230. In a preferred embodiment, first interface 246 has a first peel strength and second interface 248 has a second peel strength different from the first peel strength. In a particularly preferred embodiment, the first peel strength is greater than the second peel strength so that landing strip 230 separates cleanly from adhesive layer 226, for example, when cover 228 is moved from a closed position to an open position.

In some embodiments, substrate 238 comprises a first material having a first adhesion characteristic with relation to adhesive layer 226 and landing strip 230 comprises a second material having a second adhesion characteristic with relation to adhesive layer 226. In some embodiments, the first material comprises a first polymeric material and the second material comprises a second polymeric material different from the second polymeric material. Also in some embodiments, the first material comprises a polymeric material having a first surface energy and the second material comprises a polymeric material having a second surface energy different from the first surface energy.

Figure 6:
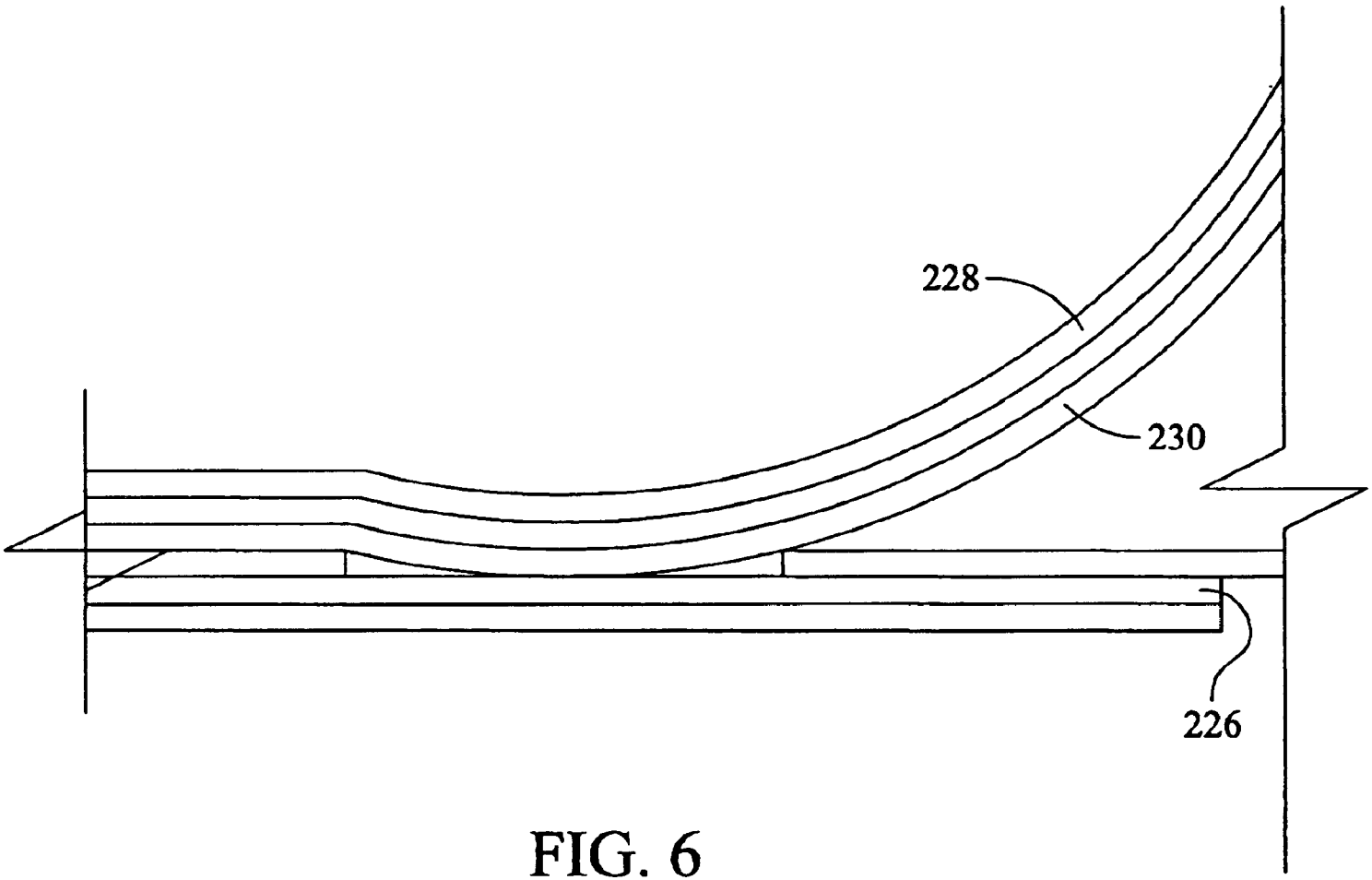
FIG. 6 is an additional cross section view of the assembly of FIG. 4 and FIG. 5.

FIG. 6 is an additional cross section view of the assembly of FIG. 4 and FIG. 5. In the embodiment of FIG. 6, landing strip 230 and cover 228 are shown having a generally arcuate shape. In some methods in accordance with the present invention, landing strip 230 is deflected to assume a generally arcuate shape by pulling a distal portion of landing strip 230 in an opening direction. Landing strip 230 may be urged to assume an arcuate shape, for example, when landing strip 230 is being peeled away from adhesive layer 226.

Figure 7:
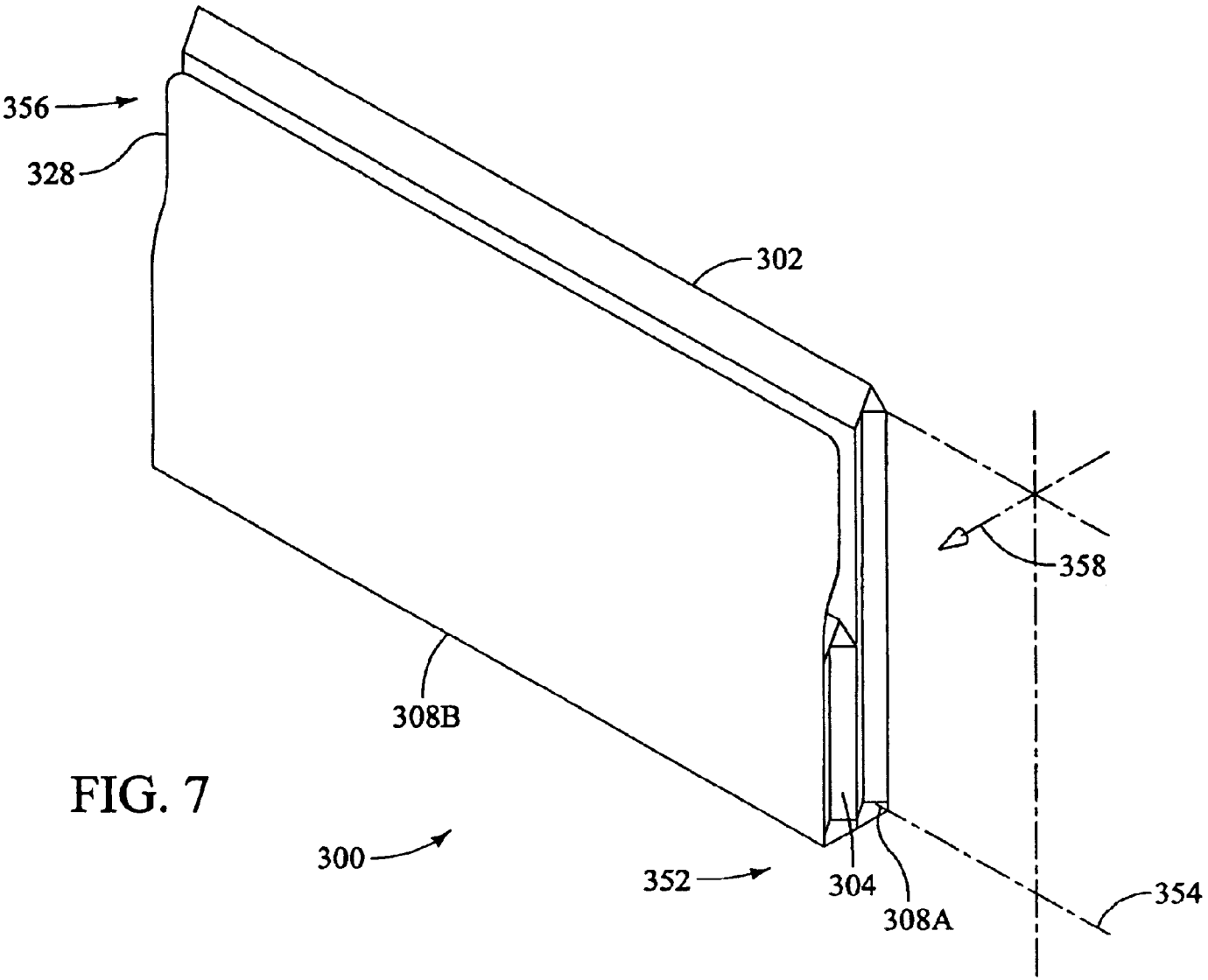
FIG. 7 is a perspective view of a package in accordance with the present invention.

FIG. 7 is a perspective view of a package 300 in accordance with the present invention. In the exemplary embodiment of FIG. 7, package 300 includes a first pocket 302, a second pocket 304, and a cover 328. Cover 328 includes a proximal end 352 coupled to first pocket 302 at a first fold line 308A. A fold axis 354 is illustrated with a dashed line in FIG. 7. In a preferred embodiment, cover 328 hinges about fold axis 354. In the embodiment of FIG. 7 cover 328 is also folded at a second fold line 308B. In a preferred embodiment, first fold line 308A and second fold line 308B each comprise a localized area of weakness. This localized area of weakness may comprise various elements without deviating from the spirit and scope of the present invention. Examples of elements which may be suitable in some applications include a perf cut, a score cut, and a crease.

In the embodiment of FIG. 7, cover 328 is shown in a closed position. One method in accordance with the present invention includes the step of a pulling distal portion 356 of cover 328 in an opening direction 358 to urge cover 328 into an open position. Opening direction 358 is illustrated with an arrow in FIG. 7. In FIG. 7 it may be appreciated that opening direction 358 is generally perpendicular to fold axis 354.

Figure 8:
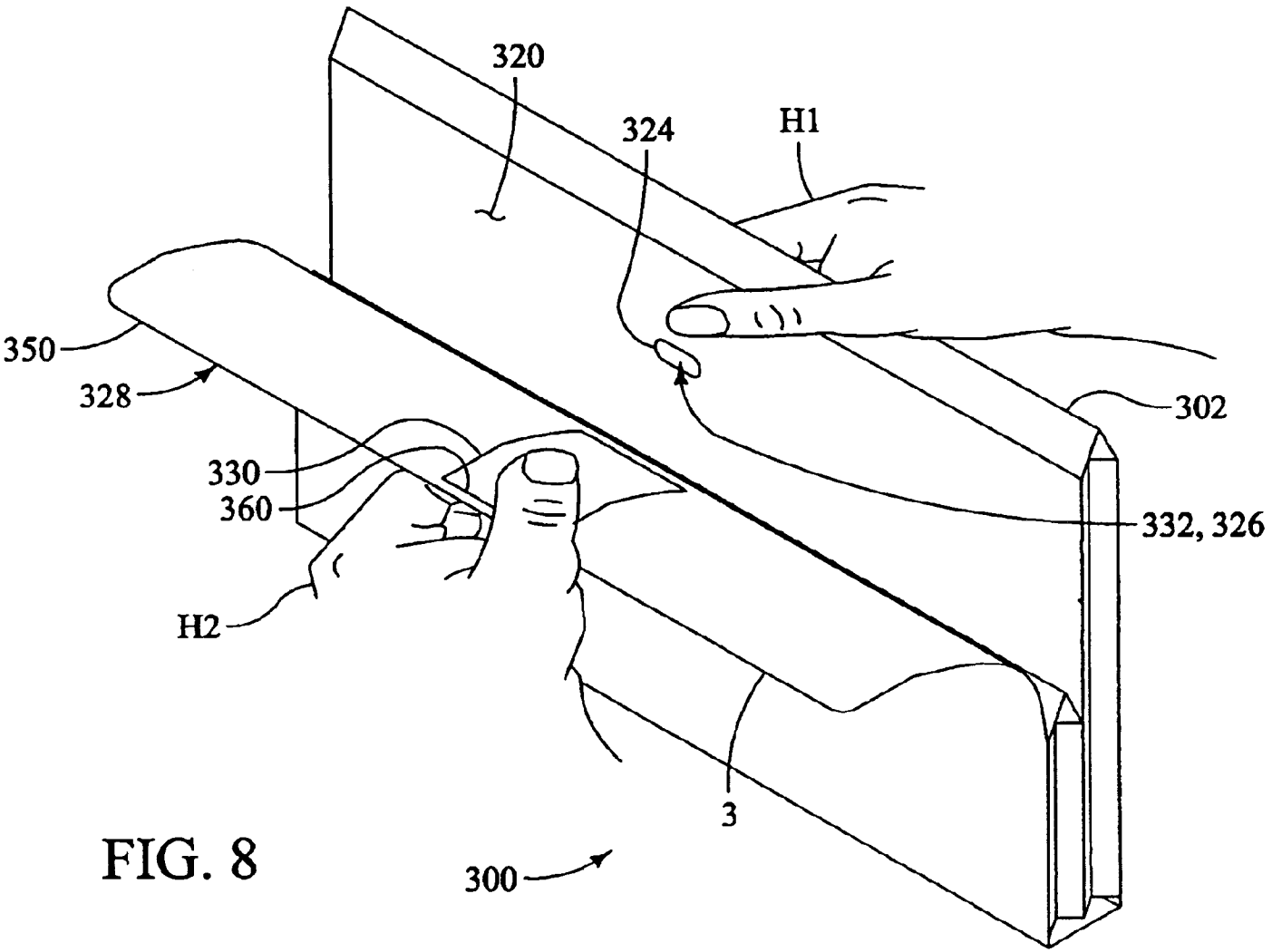
FIG. 8 is an additional perspective view of package of FIG. 7.

FIG. 8 is an additional perspective view of package 300 of FIG. 7. In FIG. 8, a first hand H1 is shown grasping first pocket 302 of package 300 and a second hand H2 is shown grasping cover 328. In FIG. 8 it may be appreciated that a landing strip 330 is grasped between a thumb and a finger of second hand H2. In the embodiment of FIG. 8, landing strip 330 has a distal end 360 that is disposed proximate a distal end 350 of cover 328. In the embodiment of FIG. 8, cover 328 and landing strip 330 both have a generally arcuate shape.

Landing strip 330 is preferably affixed to cover 328, for example, with adhesive. Landing strip 330 is preferably positioned such that landing strip 330 will overlay an aperture 324 defined by wall 320 of first pocket 302 when cover 328 is disposed in a closed position. In a preferred embodiment, landing strip 330 may be selectively fixed to an exposed portion 332 of an adhesive layer 326 to selectively hold cover 328 in the closed position. A package in accordance with the present invention may be opened by grasping a first pocket of the package with one hand, grasping a cover of the package with another hand, and peeling the landing strip away from the exposed portion of the adhesive layer.

Figure 9:
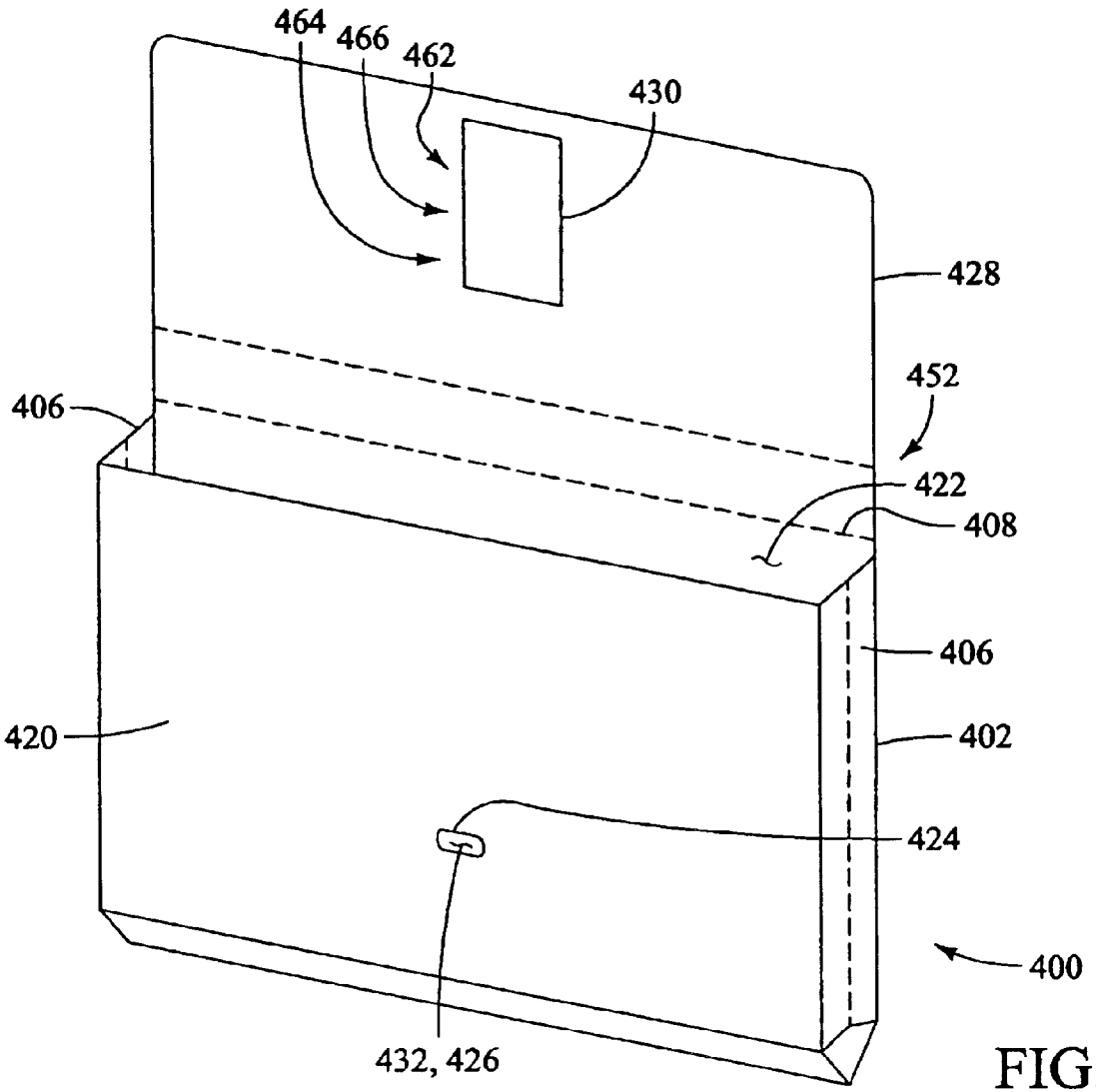
FIG. 9 is a perspective view of a package in accordance with an additional exemplary embodiment of the present invention.

FIG. 9 is a perspective view of a package 400 in accordance with an additional exemplary embodiment of the present invention. In the exemplary embodiment of FIG. 9, package 400 includes a first pocket 402. In FIG. 9 it may be appreciated that first pocket 402 includes gusseted sides 406. In a preferred embodiment, gusseted sides 406 are sized so that first pocket 402 has the capacity to receive at least a double set of prints.

In the embodiment of FIG. 9, first pocket 402 comprises a wall 420 defining a cavity 422 and an aperture 424. In the embodiment of FIG. 9, an adhesive layer 426 is disposed within cavity 422 of first pocket 402. In FIG. 9, an exposed portion 432 of adhesive layer 426 can be seen overlaying aperture 424. Package 400 also includes a cover 428 having a proximal end 452 coupled to first pocket 402 at a fold line 408. In the embodiment of FIG. 9, cover 428 is shown in an open position.

In FIG. 9, a landing strip 430 is shown affixed to cover 428. Landing strip 430 is preferably positioned such that landing strip 430 will overlay aperture 424 when cover 428 is disposed in a closed position. In a preferred embodiment, a portion of landing strip 430 may be selectively fixed to exposed portion 432 of adhesive layer 426 for selectively holding cover 428 in a closed position. In the embodiment of FIG. 9, landing strip 430 includes an upper portion 462, a lower portion 464, and an intermediate portion 466 disposed between upper portion 462 and lower portion 464.

Figure 10:
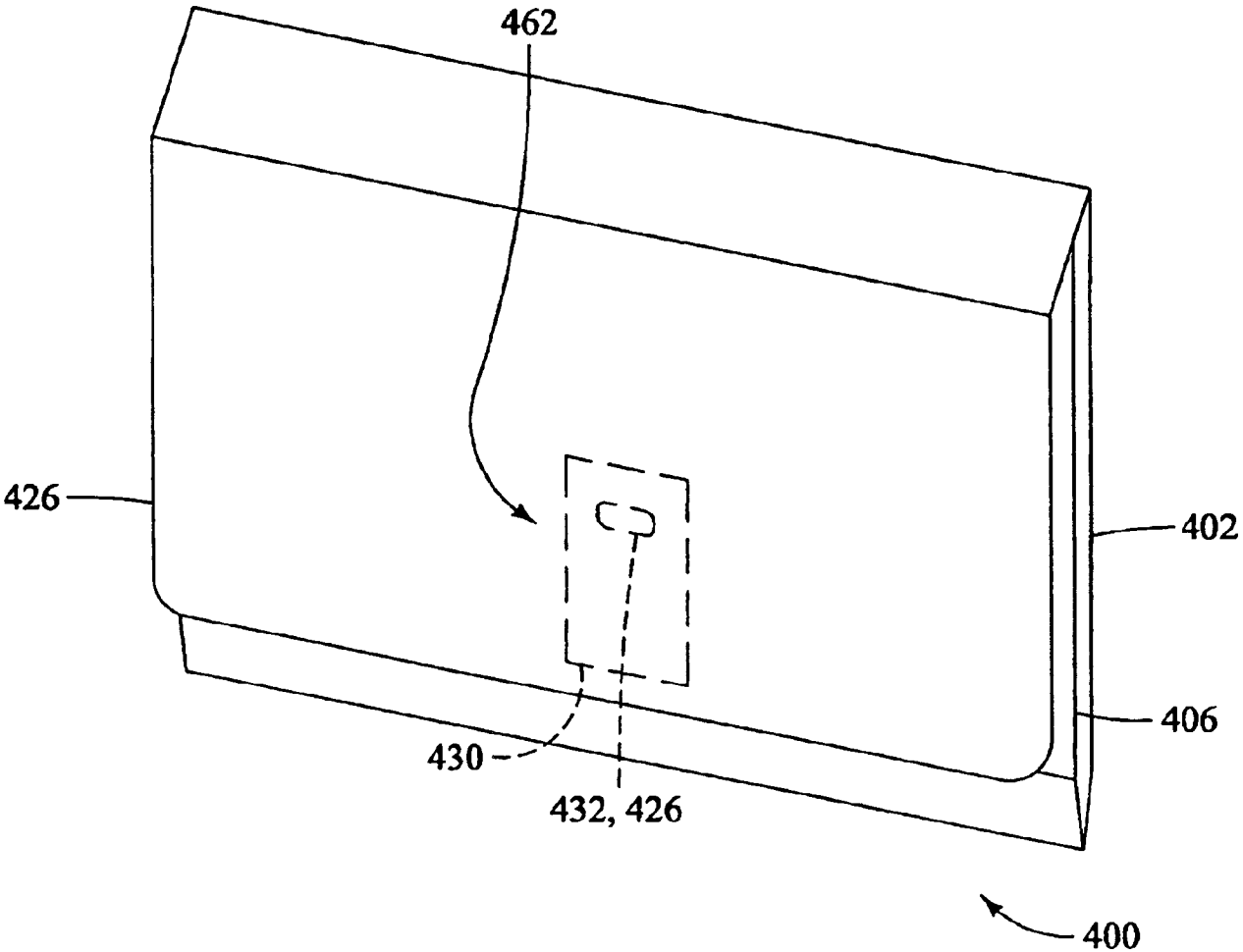
FIG. 10 is an additional perspective view of package of FIG. 9.

FIG. 10 is an additional perspective view of package 400 of FIG. 9. In the embodiment of FIG. 10, gusseted sides 406 of first pocket 402 have assumed a generally collapsed shape. In some embodiments of the present invention, gusseted sides 406 may assume a collapsed shape when first pocket 402 of package 400 is substantially empty. In the embodiment of FIG. 10, cover 428 is disposed in a closed position. In FIG. 10, it may be appreciated that exposed portion 432 of adhesive layer 426 is fixed to upper portion 462 of landing strip 430.

Figure 11:
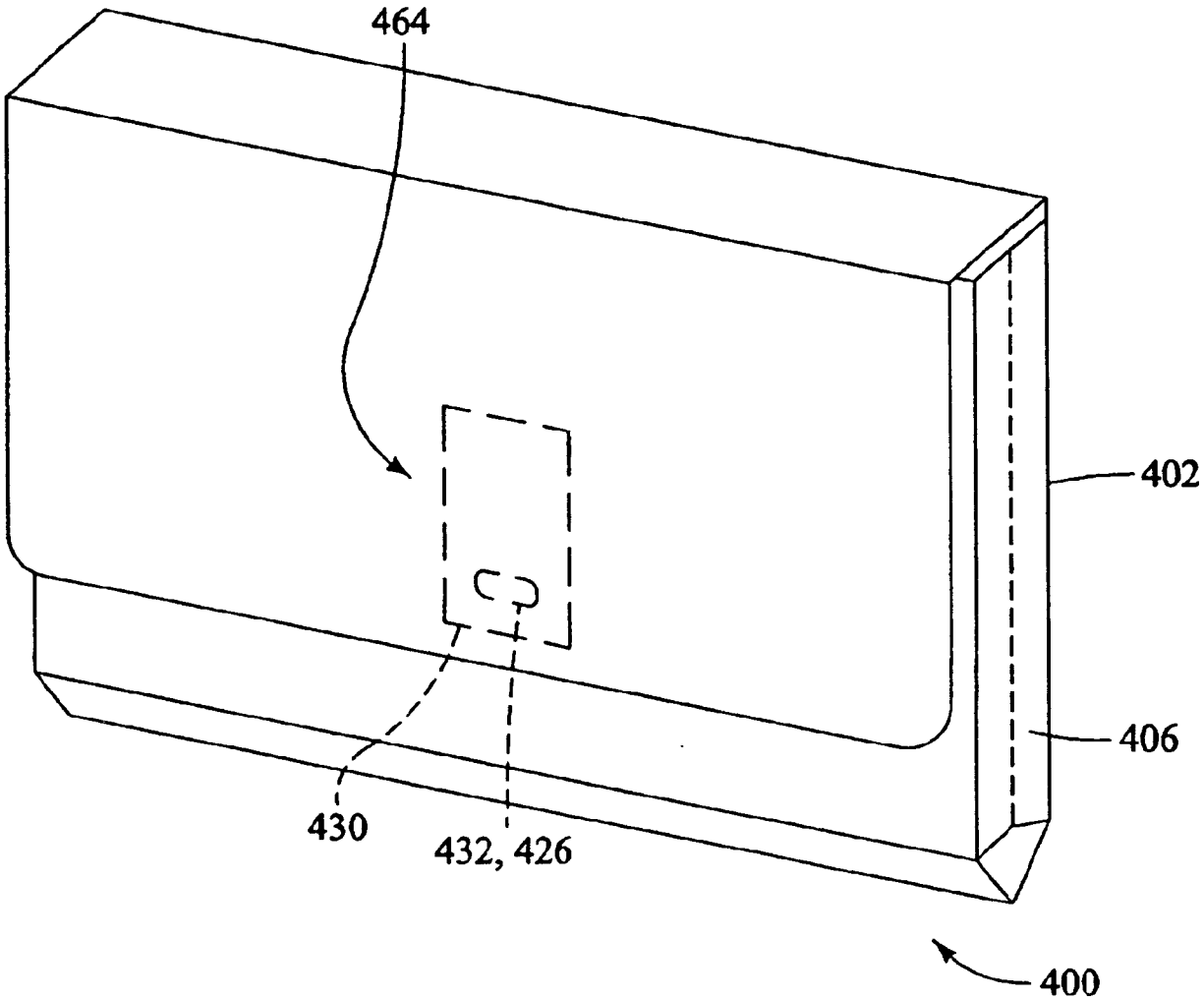
FIG. 11 is still another perspective view of package of FIG. 9.

FIG. 11 is still another perspective view of package 400 of FIG. 9. In the embodiment of FIG. 11, gusseted sides 406 of first pocket 402 have assumed a fully extended shape. In one exemplary embodiment of the present invention, gusseted sides 406 assume a fully extended shape when first pocket 402 of package 400 contains a double set of prints. In the embodiment of FIG. 11, cover 428 is disposed in a closed position. In FIG. 11, it may be appreciated that exposed portion 432 of adhesive layer 426 is fixed to lower portion 464 of landing strip 430.

Figure 12:
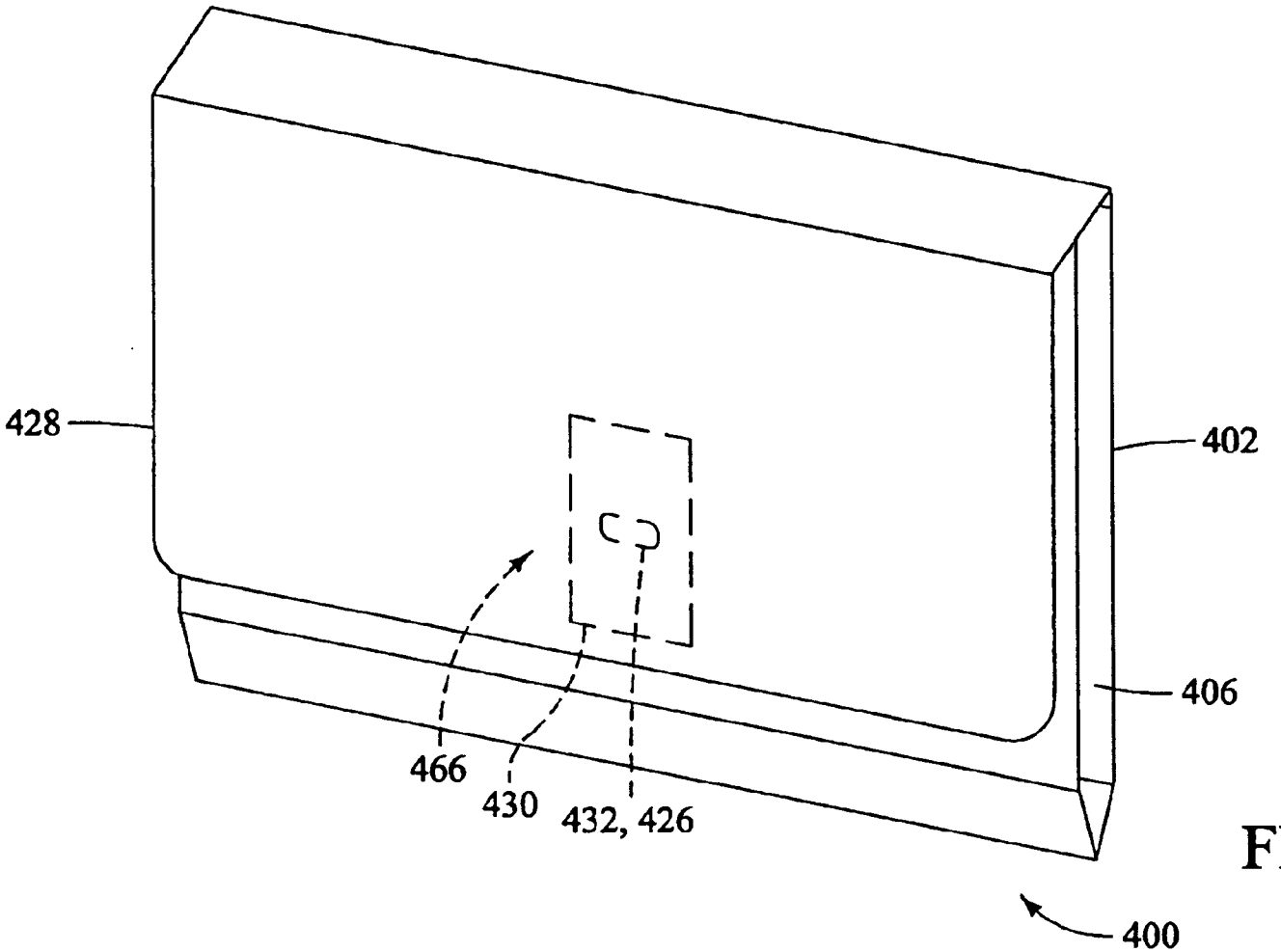
FIG. 12 is yet another perspective view of package of FIG. 9.

FIG. 12 is yet another perspective view of package 400 of FIG. 9. In the embodiment of FIG. 12, gusseted sides 406 of first pocket 402 have assumed an intermediate shape. In some exemplary embodiments of the present invention, gusseted sides 406 may assume an intermediate shape when first pocket 402 of package 400 contains something less than it's fill capacity. In the embodiment of FIG. 12, cover 428 is disposed in a closed position. In FIG. 12, it may be appreciated that exposed portion 432 of adhesive layer 426 is fixed to intermediate portion 466 of landing strip 430.

Figure 13:
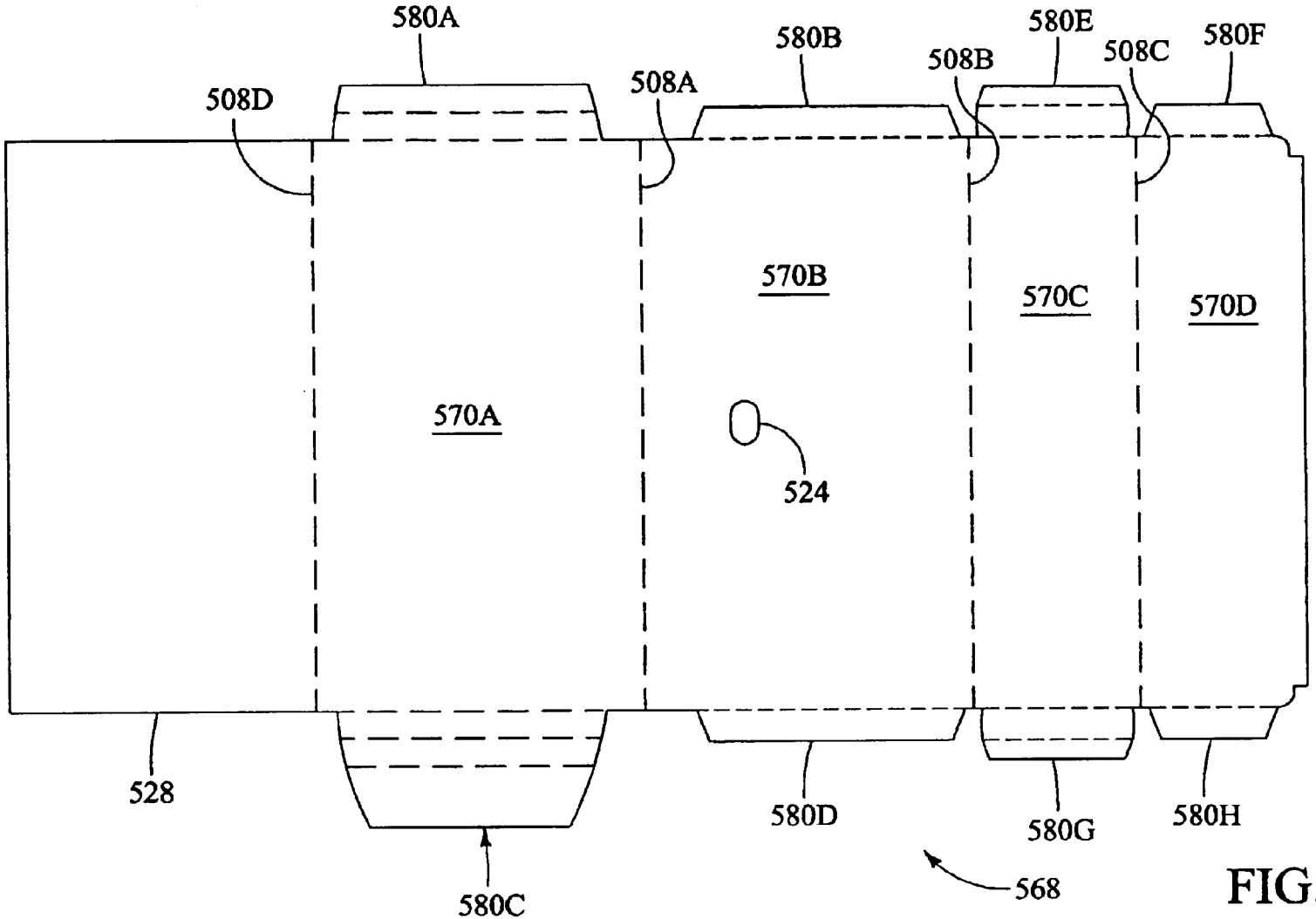
FIG. 13 is a plan view of a blank in accordance with the present invention.

FIG. 13 is a plan view of a blank 568 in accordance with the present invention. Blank 568 includes a cover 528 and a plurality of panels. A first panel 570A and a second panel 570B of blank 568 are joined at a first fold line 508A. Second panel 570B is joined to a third panel 570C at a second fold line 508B. Third panel 570C is joined to a fourth panel 570D at a third fold line 508C.

In a preferred embodiment, first panel 570A and second panel 570B are configured to form a first pocket having gusseted sides. In the embodiment of FIG. 13, first panel 570A includes a first flap 580A and a third flap 580C. Also in the embodiment of FIG. 13, second panel 570B includes a second flap 580B and a fourth flap 580D.

In FIG. 13 it may be appreciated that cover 528 of blank 568 is joined to first panel 570A at a fourth fold line 508D. In FIG. 13 it may also be appreciated that second panel 570B of blank 568 defines an aperture 524. In a preferred embodiment, third panel 570C and fourth panel 570D are configured to form a second pocket having gusseted sides. In the embodiment of FIG. 13, third panel 570C includes a fifth flap 580E and a seventh flap 580G. Also in the embodiment of FIG. 13, fourth panel 570D includes a sixth flap 580F and an eighth flap 580H.

Figure 14:
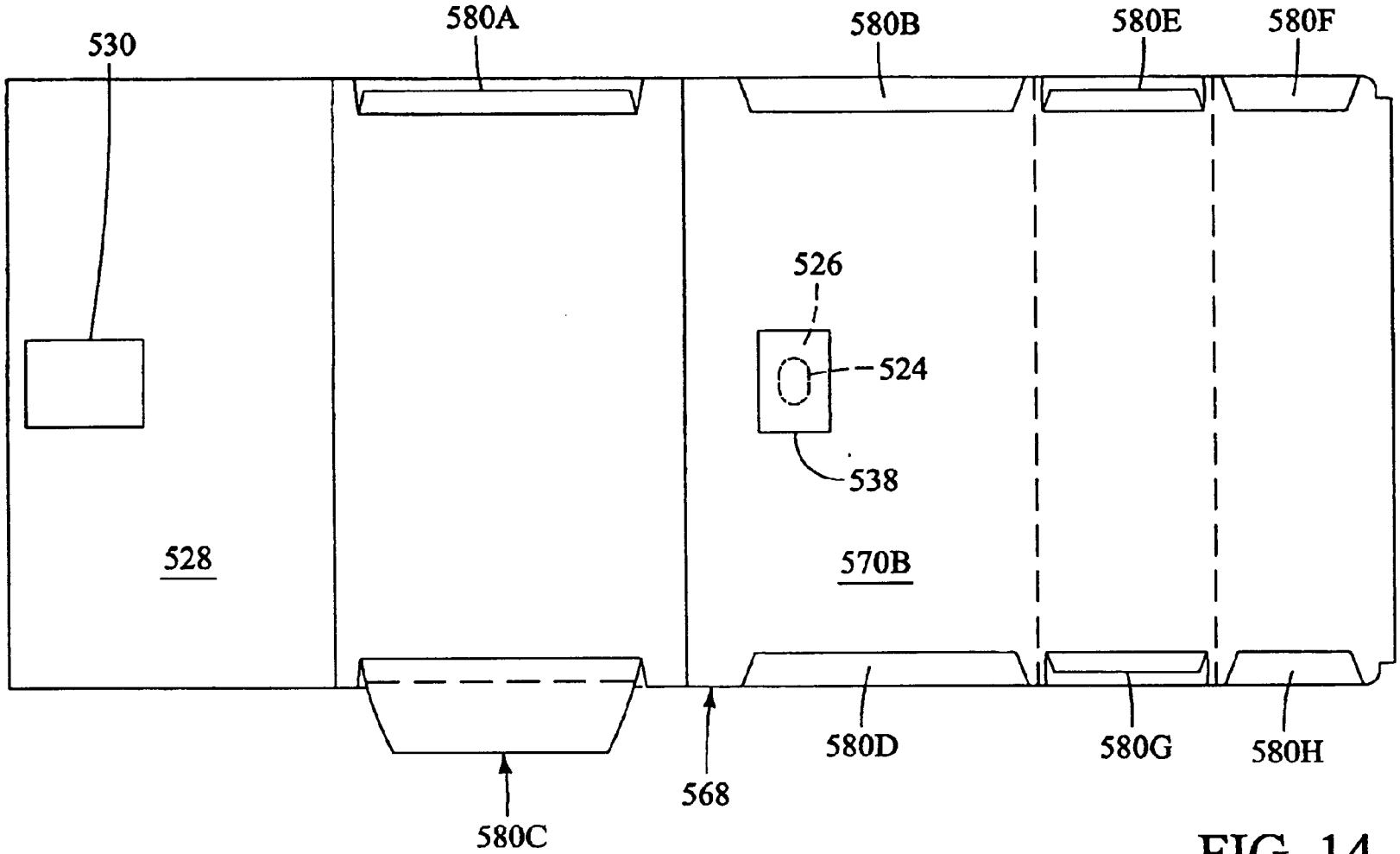
FIG. 14 is a plan view of an assembly including blank of FIG. 13.

FIG. 14 is a plan view of an assembly including blank 568 of FIG. 13. In FIG. 14, a substrate 538 is disposed over aperture 524 and an adhesive layer 526 is disposed between substrate 538 and first panel 570A. In a preferred embodiment, adhesive layer 526 securely fixes substrate 538 to second panel 570B. The assembly of FIG. 14 also includes a landing strip 530 that is fixed to cover 528, for example, with an adhesive.

In the embodiment of FIG. 14, first flap 580A and third flap 580C have each been folded two times. Also in the embodiment of FIG. 14, second flap 580B and fourth flap 580D have each been folded one time. In a preferred embodiment, these folded flaps are configured to form the gusseted sides of a first pocket.

In the embodiment of FIG. 14, fifth flap 580E and seventh flap 580G have each been folded two times. Also in the embodiment of FIG. 14, sixth flap 580F and eighth flap 580H have each been folded one time. In a preferred embodiment, these folded flaps are configured to form the gusseted sides of a second pocket.

Figure 15:
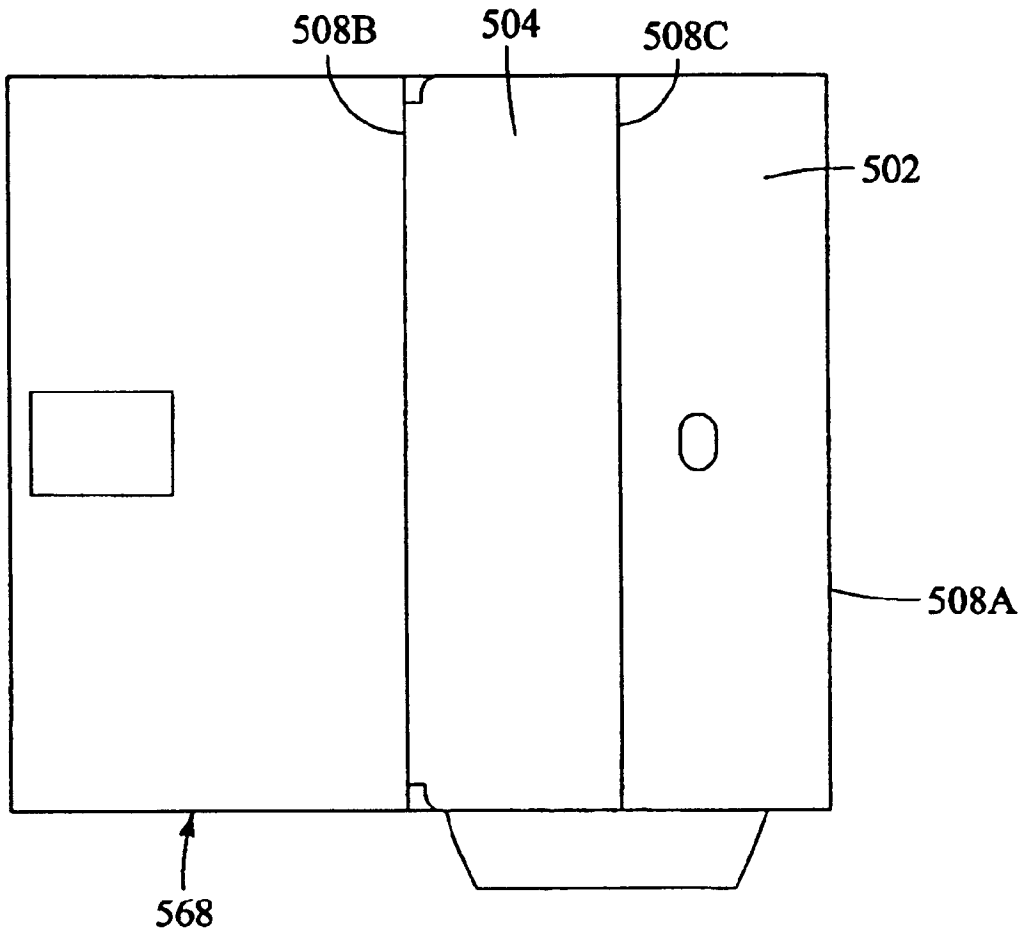
FIG. 15 is a plan view of an additional assembly formed using blank of FIG. 13.

FIG. 15 is a plan view of an additional assembly formed using blank 568 of FIG. 13.

In the embodiment of FIG. 15, blank 568 has been folded along first fold line 508A to form a first pocket 502. In a preferred embodiment, first pocket 502 includes a first gusseted side formed by fixing first flap 580A to second flap 580B, for example, by gluing. Also in this preferred embodiment, first pocket 502 includes a second gusseted side formed by fixing third flap 580C to fourth flap 580D, for example, by gluing.

A second pocket 504 is joined to first pocket 502 at second fold line 508B. In the embodiment of FIG. 15, second pocket 504 has been formed by folding blank 568 along third fold line 508C. In a preferred embodiment, second pocket 504 includes a first gusseted side formed by fixing fifth flap 580E to sixth flap 580F, for example, by gluing. Also in this preferred embodiment, second pocket 504 includes a second gusseted side formed by fixing seventh flap 580G to eighth flap 580H, for example, by gluing.

Figure 16:
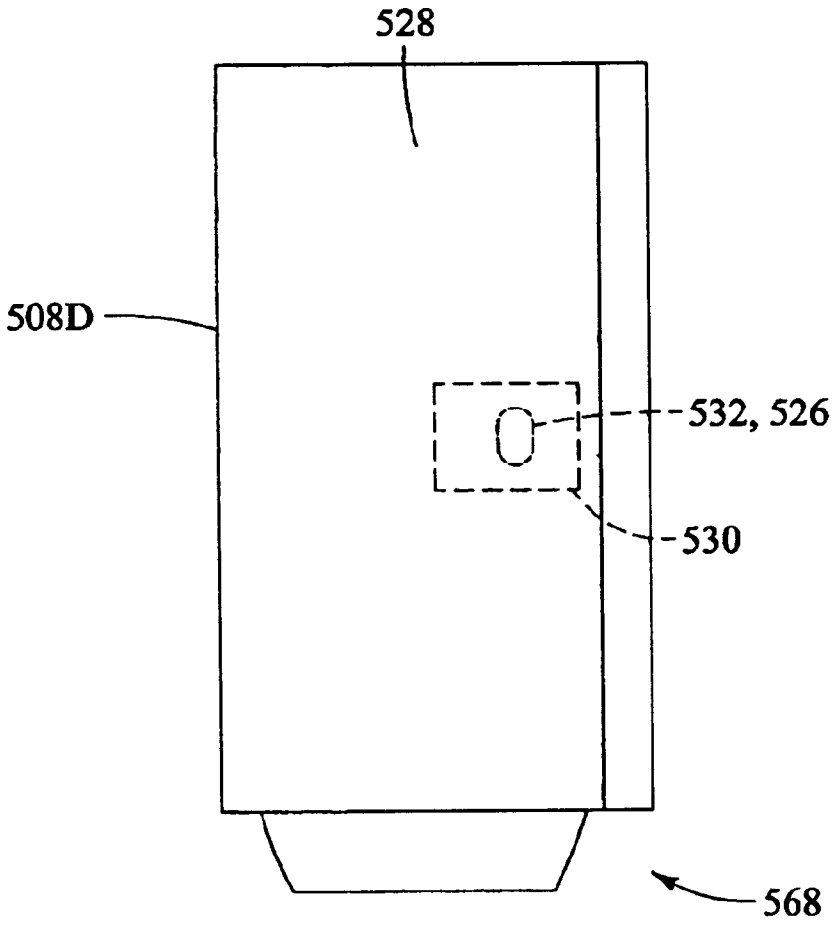
FIG. 16 is an additional plan view of the assembly of FIG. 15.

FIG. 16 is an additional plan view of the assembly of FIG. 15. In the embodiment of FIG. 16, blank 568 has been folded along fourth fold line 508D so that cover 528 of blank 568 has assumed a closed position. A portion of landing strip 530 is preferably selectively fixed to exposed portion 532 of adhesive layer 526 for selectively holding cover 528 in the closed position.

Figure 17:
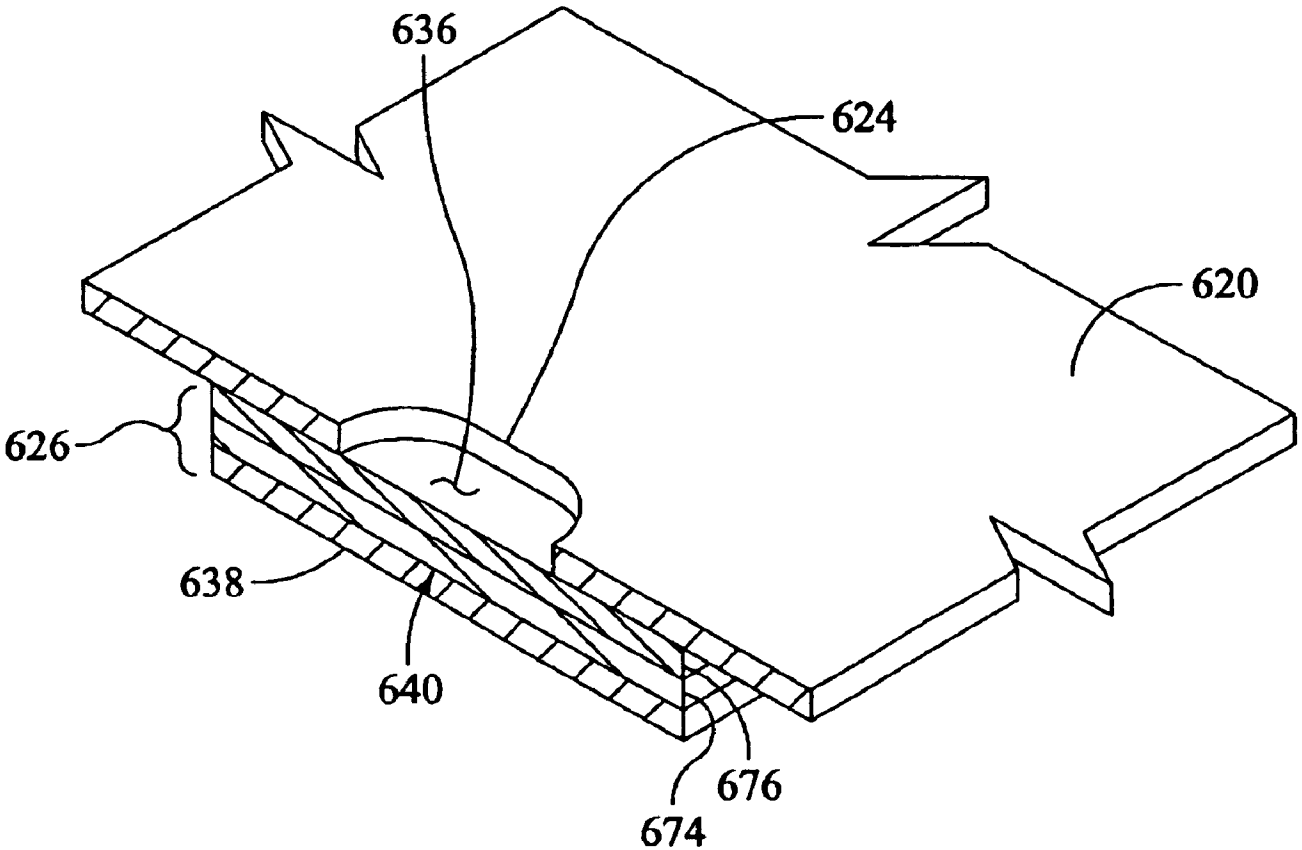
FIG. 17 is a cross sectional perspective view illustrating a portion of package in accordance with an exemplary embodiment of the present invention.

FIG. 17 is a cross sectional perspective view illustrating a portion of a package in accordance with an exemplary embodiment of the present invention. An aperture 624 defined by a wall 620 is illustrated in FIG. 17. In FIG. 17, an outer surface 636 of an adhesive layer 626 can be seen overlaying aperture 624. In FIG. 17 it may be appreciated that a substrate 638 overlays an inner surface 640 of adhesive layer 626.

In the embodiment of FIG. 17, adhesive layer 626 comprises a first adhesive 674 overlaying substrate 638 and a second adhesive 676 overlaying first adhesive 674. In a preferred embodiment, first adhesive 674 has a first adhesion strength and second adhesive 676 has a second adhesive strength different than the first adhesive strength. In a particularly preferred embodiment, first adhesive 674 has a first adhesion strength and second adhesive 676 has a second adhesive strength less than the first adhesive strength. One method which may be used to measure the peel adhesion of an adhesive material has been described by ASTM International which identifies this method with the number D-3330.

Numerous characteristics and advantages of the invention covered by this document have been set forth in the foregoing description. It will be understood, however, that this disclosure is, in many respects, only illustrative. Changes may be made in details, particularly in matters of shape, size and ordering of steps without exceeding the scope of the invention. The invention's scope is, of course, defined in the language in which the appended claims are expressed.

What is claimed is:

1. A package for holding negatives and prints, comprising:

a first pocket having gusseted sides sized receive at least a double set of prints;

a cover having a proximal portion coupled to the first pocket at a fold line;

a landing strip fixed to the cover;

an adhesive layer disposed within a chamber defined by a wall of the first pocket;

the adhesive layer overlaying an aperture defined by the wall of the first pocket so that the adhesive layer comprises a covered portion and an exposed portion;

the aperture and the landing strip being positioned so that the landing strip overlays the aperture when the cover is in a closed position;

the package further including a substrate overlaying an inner surface of the adhesive layer;

wherein the adhesive layer comprises a first adhesive overlaying the substrate and a second adhesive overlaying the first adhesive;

the first adhesive having a first adhesion strength;

the second adhesive having a second adhesion strength; and the first adhesion strength being greater than the second adhesion strength.

2. The package of claim 1, wherein the landing strip includes an upper portion and a lower portion;

the upper portion being dimensioned to overlay the exposed portion of the adhesive layer when the gusseted sides of the first pocket are in a collapsed position and the cover is in the closed position; and the lower portion being dimensioned to overlay the exposed portion of the adhesive layer when the gusseted sides of the first pocket are in an expanded position and the cover is in the closed position.

3. The package of claim 1, further including a second pocket having gusseted sides sized to receive at least a set of negatives.

4. The package of claim 3, wherein the second pocket is dimensioned to receive a cassette.

5. The package of claim 3, wherein the second pocket is coupled to the first pocket by a plurality of frangible links so that the second pocket can be selectively separated from the first pocket.

6. The package of claim 1, wherein an outer surface of the adhesive layer is disposed below an outer surface of the wall of the first pocket.

7. The package of claim 1, wherein a size of the aperture and a thickness of the wall are selected such that the landing strip and the outer surface of the adhesive layer define an angle when a portion of the landing strip is adhered to the exposed portion of the adhesive layer.

8. The package of claim 7, wherein the angle is greater than about 30 minutes.

9. The package of claim 7, wherein the angle is greater than about 1 degree.

10. The package of claim 1, wherein the covered portion of the adhesive layer has a surface area greater than a surface area of the exposed portion of the adhesive layer.

11. The package of claim 1, wherein a distal end of the landing strip is disposed proximate a distal end of the cover.

* * * * *